US006413060B1

(12) United States Patent
Tarng et al.

(10) Patent No.: US 6,413,060 B1
(45) Date of Patent: Jul. 2, 2002

(54) OIL PASSAGE FOR SCROLL COMPRESSOR

(75) Inventors: Guang-Der Tarng, Hsin Chu Hsien; Lung-Tsai Chang, Hsin Chu, both of (TW)

(73) Assignee: Rechi Precision Co., Ltd., Tao Yuan Hsien (TW)

( * ) Notice: Subject to any disclaimer, the term of this patent is extended or adjusted under 35 U.S.C. 154(b) by 0 days.

(21) Appl. No.: 09/766,629

(22) Filed: Jan. 23, 2001

(51) Int. Cl.[7] ..... F04C 18/04; F04C 29/02
(52) U.S. Cl. ..... 418/55.6
(58) Field of Search ..... 418/55.6, 94

(56) References Cited

U.S. PATENT DOCUMENTS 4,065,279 A * 12/1977 McCullough ..... 418/55.6
4,734,020 A * 3/1988 Inaba et al. ..... 418/55.6
4,772,188 A * 9/1988 Kimura et al. ..... 418/55.6

* cited by examiner

*Primary Examiner*—John J. Vrablik
(74) *Attorney, Agent, or Firm*—Rosenberg, Klein & Lee

(57) ABSTRACT

An oil passage for scroll compressor comprises a plurality of slanting gutters on top surface of the main bearing frame of the scroll compressor. The main bearing frame has a groove and an annular ring formed on topside thereof. The groove is communicated with the slanting gutters and the slanting gutters are slantingly intersected with the annular ring. The oil flows from the groove into the gutter, and then flows to the annular ring or topside of the main bearing frame to provide lubrication. The crumbs or crud also flow out of the topside of the main bearing frame through the gutter.

1 Claim, 8 Drawing Sheets

OIL PASSAGE FOR SCROLL COMPRESSOR

FIELD OF THE INVENTION

The present invention relates to an oil passage for compressor, especially to an oil passage for a scroll compressor to prevent crumbs or crud from coming into the passage between an orbit scroll member and a main bearing frame of the scroll compressor.

BACKGROUND OF THE INVENTION

FIGS. 1 and 2 show a prior art scroll compressor, which comprises a fixed scroll member 1*a*, an orbit scroll member 2*a*, an isolation block 3*a* and a main bearing frame 4*a*. The fixed scroll member 1*a* and the orbit scroll member 2*a* are engaged to each other to form a plurality of closed spaces 20*a*. The volumes of the plurality of closed spaces 20*a* become smaller from outer portion to center portion of the scroll compressor. The orbit scroll member 2*a* is mounted upon the main bearing frame 4*a* and rotated around the fixed scroll member 1*a* by external force such that low-pressure working fluid is flowed into the closed spaces 20*a*. Afterward, the orbit scroll member 2*a* disturbs the working fluid such that the working fluid is ejected form a discharging port 10*a* at center of the fixed scroll member 1*a* with high pressure, thus finishing the compression stroke for the working fluid.

Moreover, the main bearing frame 4*a* has an inner space 40*a*, the bottom part of the inner space 40*a* is connected to a bushing hole 41*a*. The bushing hole 41*a* houses an eccentric shaft 50*a* and the eccentric shaft 50*a* has an eccentric flange 51*a* on topside thereof. The eccentric flange 51*a* is engaged with the bottom part of the orbit scroll member 2*a* in the inner space 40*a*. As shown in FIGS. 2 and 3, the bushing hole 41*a* has an oil inlet 42*a* near the inner space 40*a* and the oil inlet 42*a* is connected to an oil passage 43*a*. The oil passage 43*a*. The outlet of the oil passage 43*a* is connected to an annular rail 44*a* atop the main bearing frame 4*a*. The lubricating oil flows along the surface of the bushing hole 41*a* to the oil inlet 42*a* by the rotation of the eccentric shaft 50*a*. The oil then flows to the annular rail 44*a* atop the main bearing frame 4*a*. The oil within and around the annular rail 44*a* is functioned to provide lubrication between the main bearing frame 4*a* and the orbit scroll member 2*a*.

However, the oil is flowed to the junction between the main bearing frame 4*a* and the orbit scroll member 2*a* after a long distance. The oil may contain some crumbs or crud and the crumbs or crud are brought to the junction between the main bearing frame 4*a* and the orbit scroll member 2*a* by the oil. The crumbs or crud within the oil cause the abrasion of the junction between the main bearing frame 4*a* and the orbit scroll member 2*a* and degrades the relative rotation between the main bearing frame 4*a* and the orbit scroll member 2*a*. Therefore, the problem of crumbs or crud within the oil becomes important issues for the scroll compressor.

SUMMARY OF THE INVENTION

It is the object of the present invention to provide an oil passage for a scroll compressor to prevent crumbs or crud from coming into the passage between an orbit scroll member and a main bearing frame of the scroll compressor. The oil passage can also prevent excessive oil from flowing into the compression chamber to enhance compression efficiency.

To achieve the above object, the present invention provides an oil passage for scroll compressor, wherein a plurality of slanting gutters are provided on top surface of the main bearing frame. The scroll compressor comprises an orbit scroll member, a fixed scroll member, and a main bearing frame. The orbit scroll member is engaged with the fixed scroll member; and the orbit scroll member is on the main bearing frame and orbits the fixed scroll member. The main bearing frame has a groove and an annular ring formed on topside thereof. The groove is communicated with the slanting gutters and the slanting gutters are slantingly intersected with the annular ring. A trench is formed between the gutter and the groove to facilitate the oil to flow into the gutter. The oil flows from the groove into the gutter, and then flows to the annular ring or topside of the main bearing frame to provide lubrication. The crumbs or crud are also flow out of the topside of the main bearing frame through the gutter.

The various objects and advantages of the present invention will be more readily understood from the following detailed description when read in conjunction with the appended drawing, in which:

DETAILED DESCRIPTION OF THE INVENTION

Figure 1:
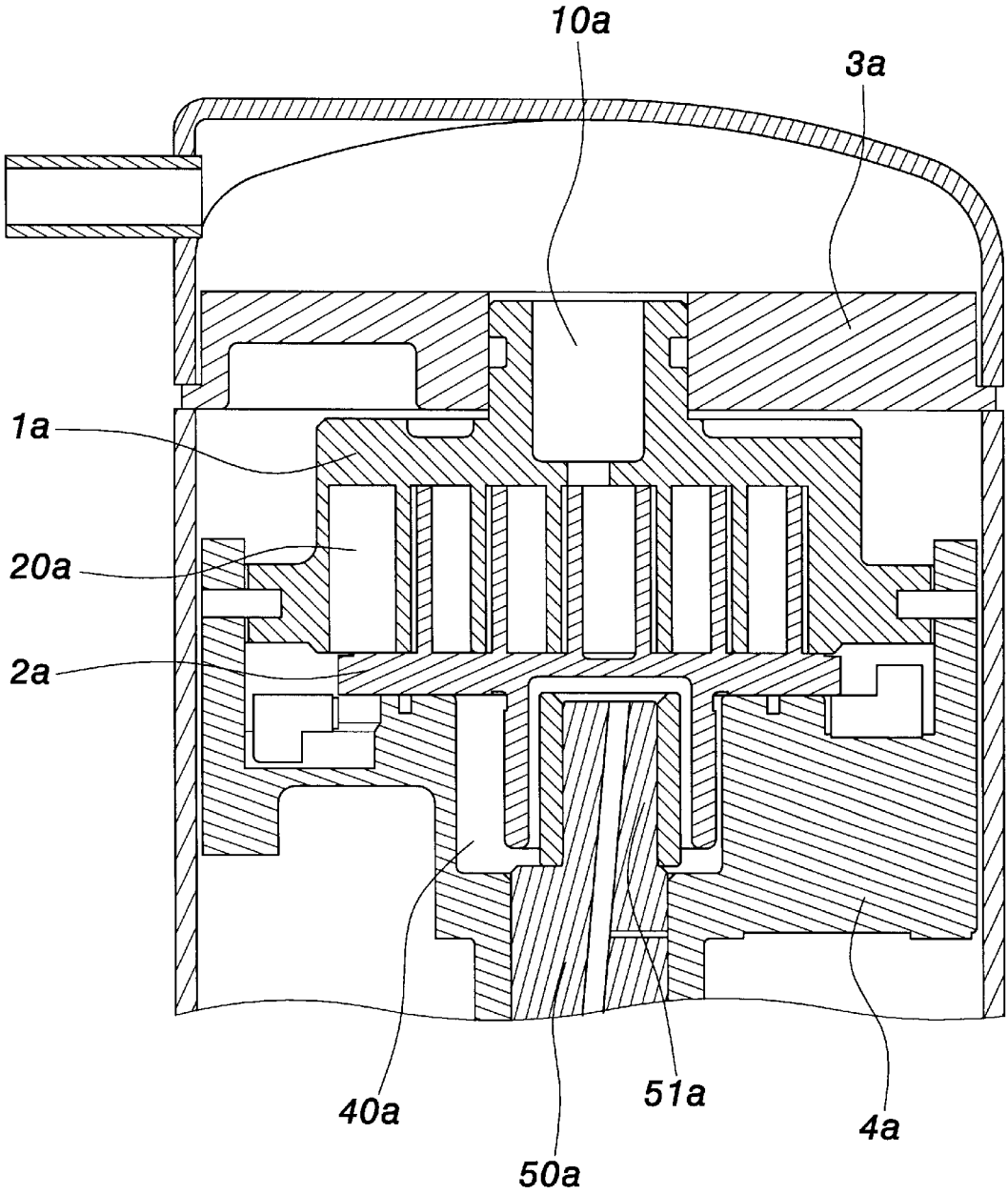
FIG. 1 PRIOR ART
FIG. 1 is a sectional view of a prior art compressor.
Figure 2:
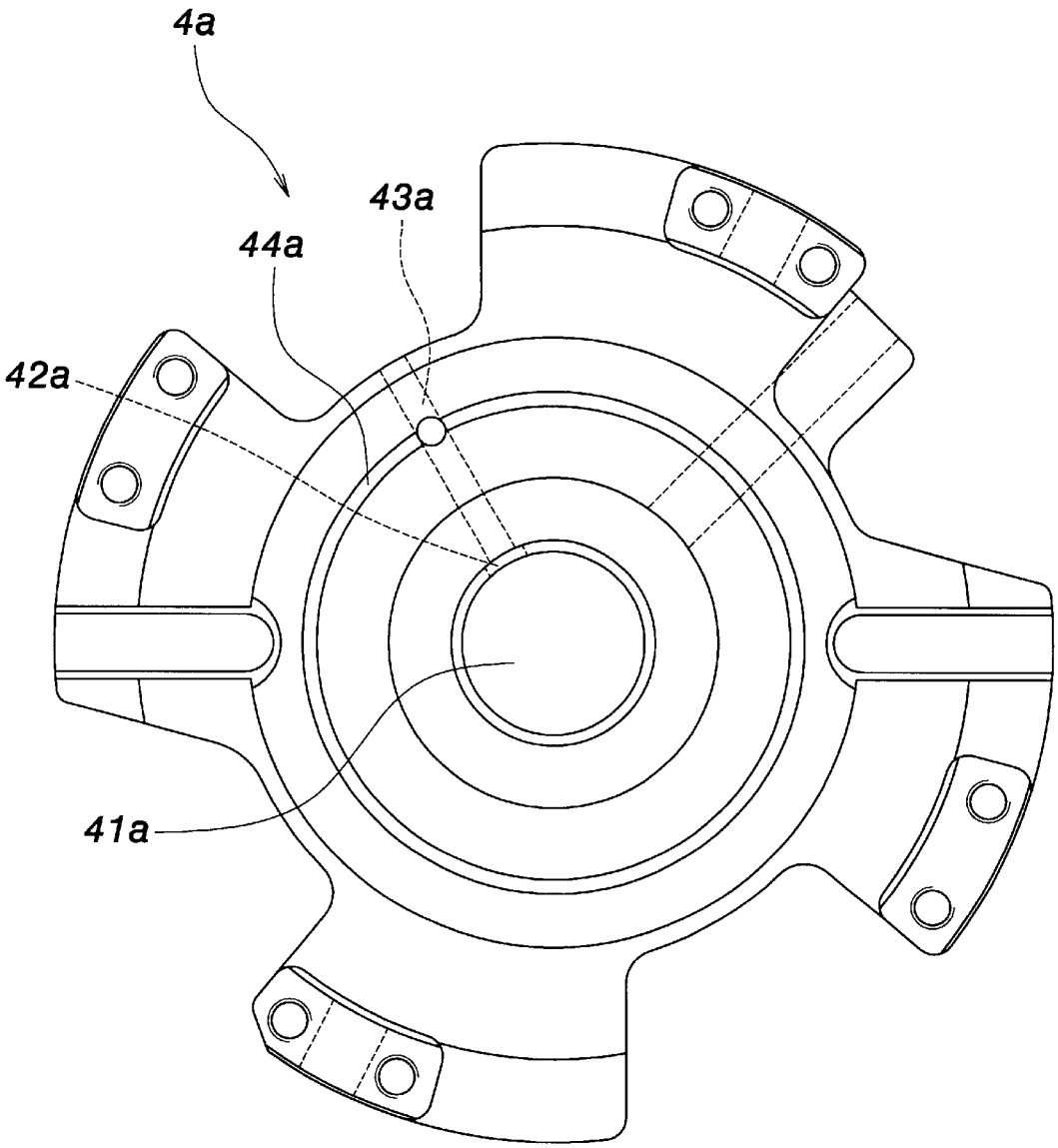
FIG. 2 PRIOR ART
FIG. 2 is a top view of the oil passage of the prior art compressor.
Figure 3:
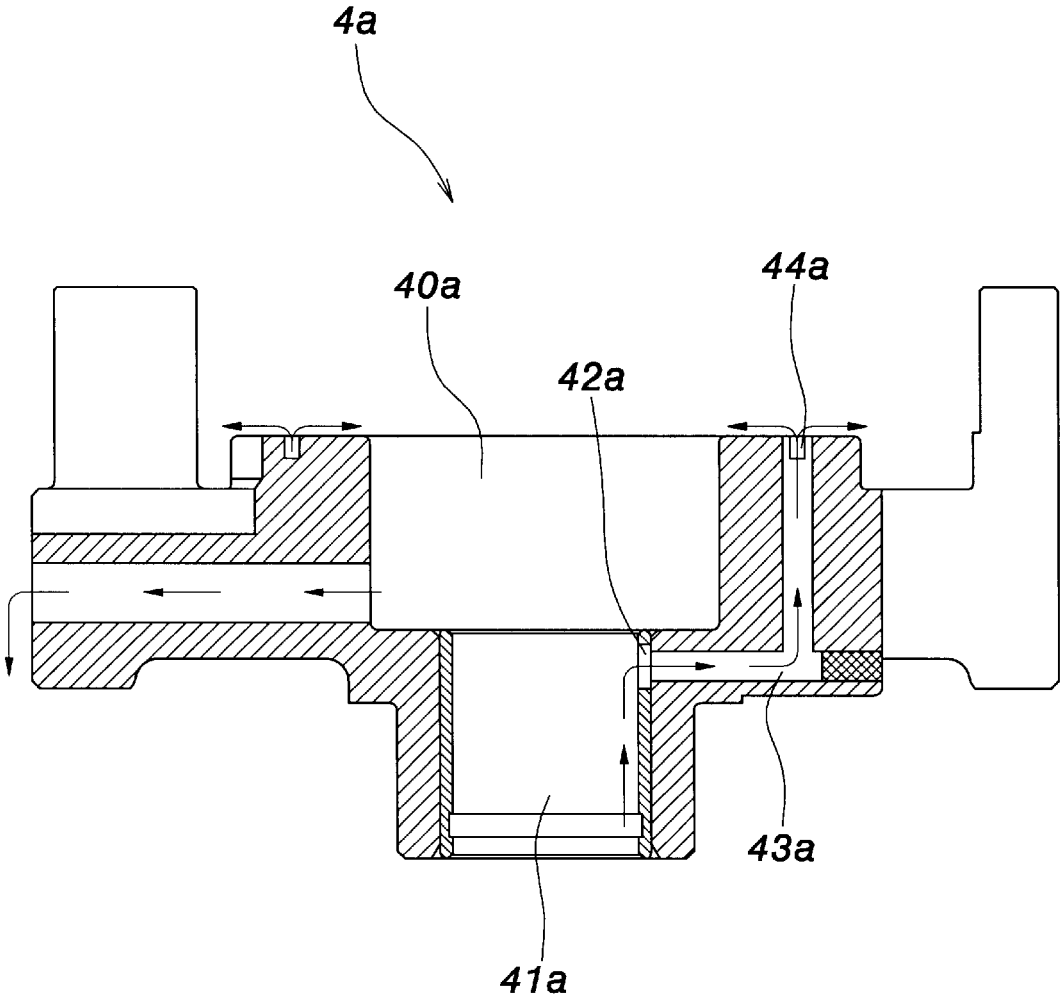
FIG. 3 PRIOR ART
FIG. 3 is a sectional view of the oil passage of the prior art compressor.
Figure 4:
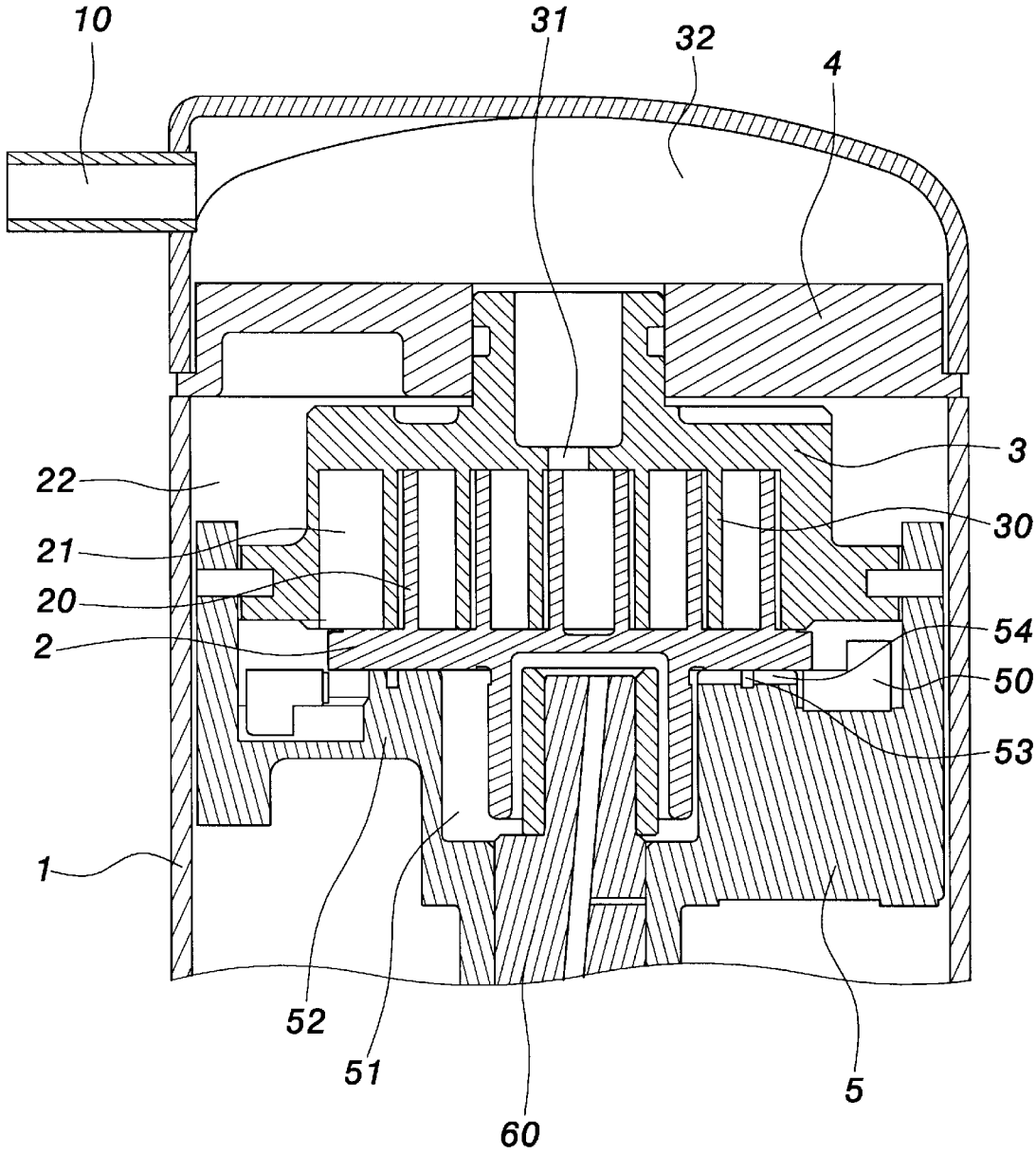
FIG. 4 is a sectional view of the present invention.

FIG. 4 shows a sectional view of a compressor according to the present invention. The compressor mainly comprises a case 1, an orbit scroll member 2, a fixed scroll member 3, an isolation block 4 and a main bearing frame 5. The orbit scroll member 2 and the fixed scroll member 3 have a set of scroll warps 20 and 30 engaged to each other to form a compression chamber 21 composed of a plurality of closed spaces. The orbit scroll member 2 is pressed by the fixed scroll member 3 to mount on the main bearing frame 5. The orbit scroll member 2 is driven by an eccentric shaft 60, and the main bearing frame 5 has an Oldham ring 50 atop thereof to confine the rotation of the orbit scroll member 2 form revolution. The isolation block 4 is placed within the case 1 and divides the case 1 into a low-pressure chamber 22 and a high-pressure chamber 32. A discharging port 31 is arranged at center of the fixed scroll member 3 and connecting the low-pressure chamber 22 and the high-pressure chamber 32.

The low-pressure working fluid is sucked into the compression chamber 21 through an inlet (not shown) and disturbed by the orbit scroll member 2 to form a high-pressure working fluid. The high-pressure working fluid is ejected from the discharging port 31 arranged on the fixed scroll member 3 and out of the compressor through an exit hose 10 on the case 1.

Moreover, the main bearing frame 5 has a groove 51 to house the bottom part of the orbit scroll member 2 and the eccentric shaft 60, which are inter-engaged. A ring 52 is formed around the groove 51 and an annular rail 53 is formed atop the ring 52. The annular rail 53 contains lubricating oil to provide lubrication to the bottom end of the orbit scroll member 2 and the top end of the main bearing frame 5 when they are in contact.

Figure 5:
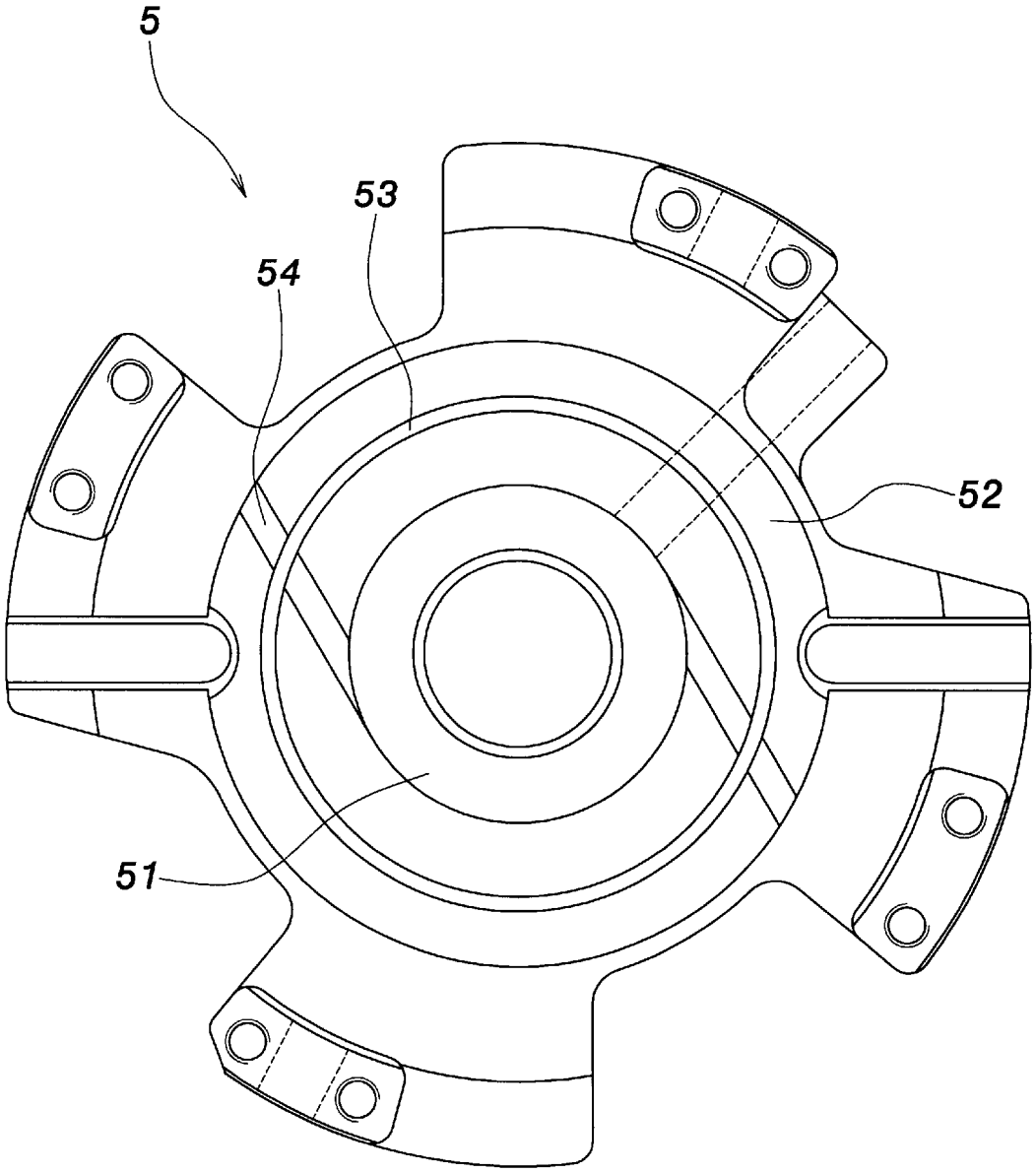
FIG. 5 is a top view of the oil passage of a preferred embodiment of the present invention.
Figure 6:
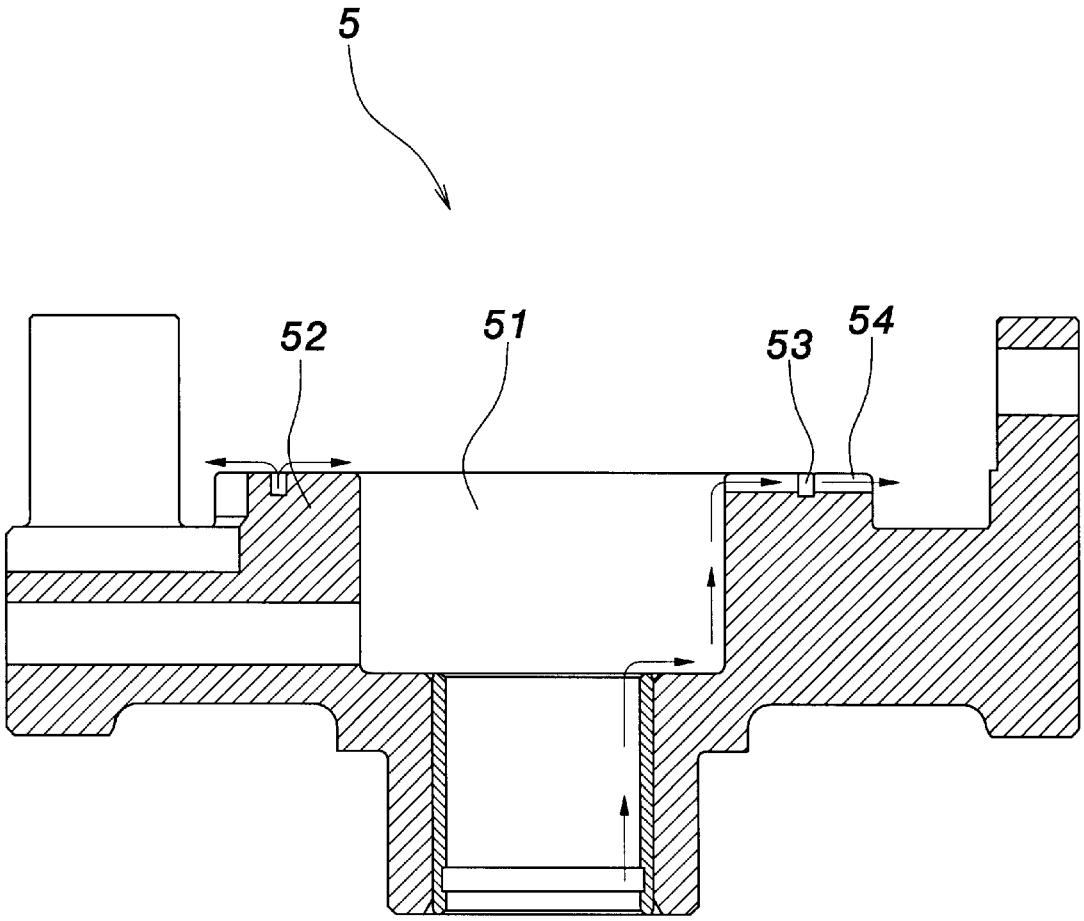
FIG. 6 is a sectional view of the oil passage of a preferred embodiment of the present invention.

With reference now to FIGS. 5 and 6, the main bearing frame 5 has at least one slanting gutter 54 on top surface thereof, and the slanting gutter 54 is formed slantingly through the topside of the ring 52 and slantingly intersected with the annular rail 53. When the eccentric shaft 60 is rotated, the oil is flowed to the groove 51 along channels on the eccentric shaft 60 or the bushing hole. The oil is then flowed to the slanting gutter 54 along the surface of the groove 51 by the centrifugal force provided by the eccentric shaft 60 rotating the orbit scroll member 2. The oil flowed into the slanting gutter 54 can be flowed into the annular rail 53 or out of topside of the main bearing frame 5. Therefore, the topside of the main bearing frame 5 can be lubricated and the crumbs or crud in the oil can be brought out of the main bearing frame 5 through the gutter 54. The crumbs or crud of the oil will not be brought to the topside of the main bearing frame 5 and will not abrade the topside of the main bearing frame 5. Moreover, no excessive oil will be flowed into the compression chamber 21.

Figure 7:
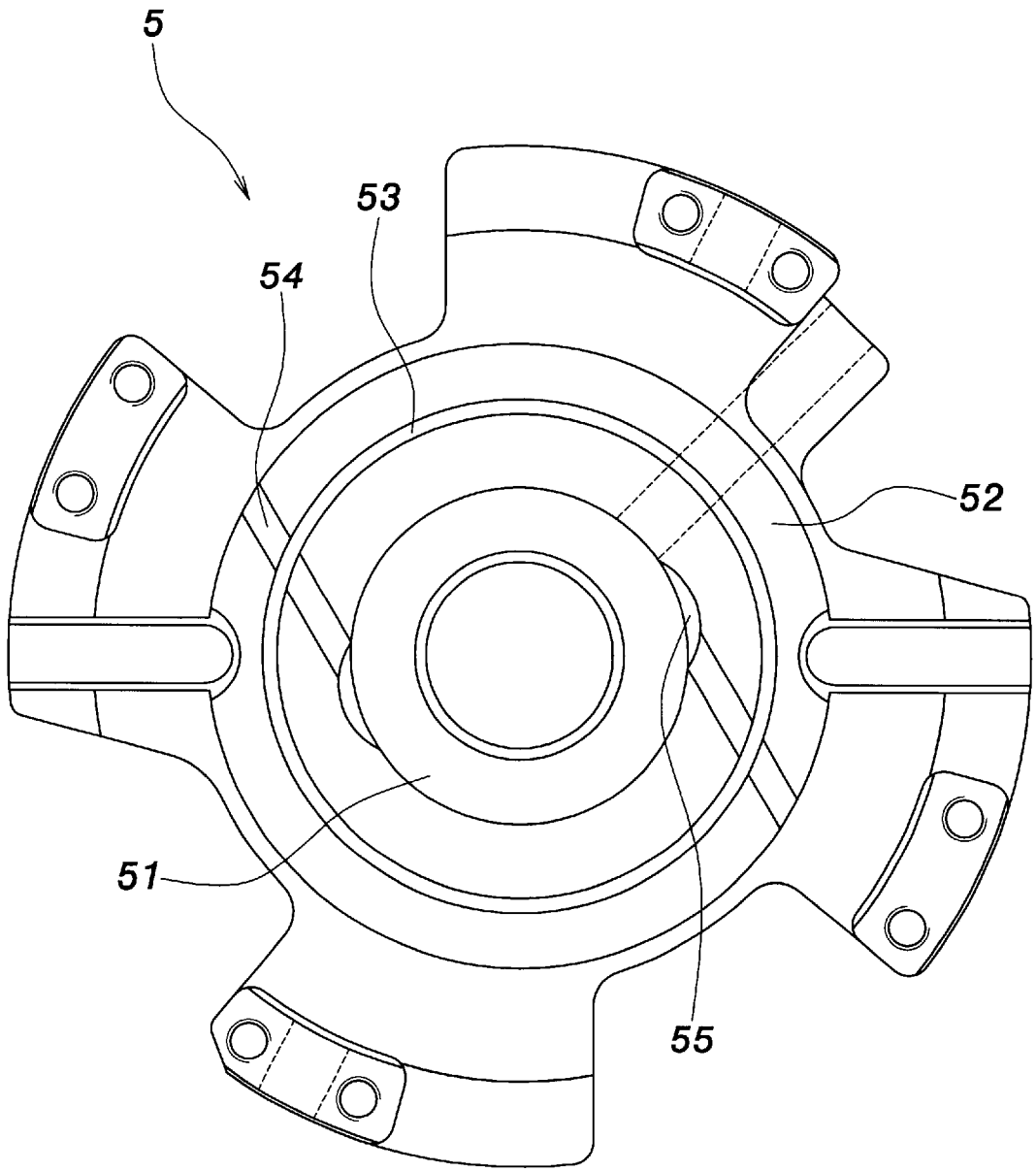
FIG. 7 is a top view of the oil passage of another preferred embodiment of the present invention.
Figure 8:
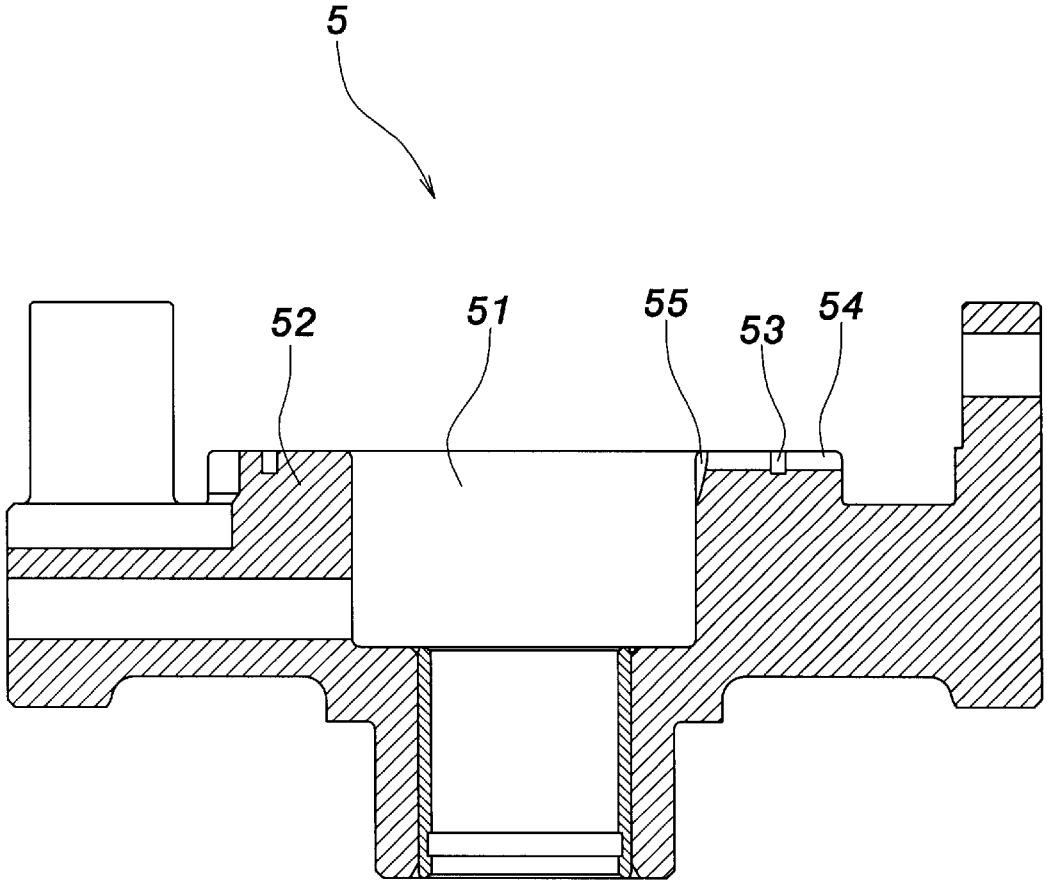
FIG. 8 is a sectional view of the oil passage of another preferred embodiment of the present invention.

With reference now to FIGS. 7 and 8, at least one trench 55 is formed between the gutter 54 and the groove 51 to facilitate the oil to flow into the gutter 54.

Although the present invention has been described with reference to the referred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

We claim:

1. An oil passage for a scroll compressor comprising a groove formed at a center of a main bearing frame;

a ring formed around said groove and an annular rail formed atop said ring;

at least one inclined gutter formed atop said ring and connected to said groove;

said inclined gutter formed slantingly through topside of said bearing surface and slantingly intersected with said annular rail; and, at least one trench formed between said inclined gutter and said groove.

* * * * *